United States Patent [19]

Dawe et al.

[11] Patent Number: 4,638,874

[45] Date of Patent: Jan. 27, 1987

[54] DRILL ADAPTOR

[75] Inventors: Stephen G. Dawe, Middelburg; James A. Brews, Springs, both of South Africa

[73] Assignee: Coalequip (Proprietary) Limited, Transvaal, South Africa

[21] Appl. No.: 517,365

[22] Filed: Jul. 26, 1983

[30] Foreign Application Priority Data

Jul. 26, 1982 [ZA] South Africa ..... 82/5334
Nov. 26, 1982 [ZA] South Africa ..... 82/8725

[51] Int. Cl.[4] ..... E21B 17/00
[52] U.S. Cl. ..... 175/321; 403/350
[58] Field of Search ..... 175/320-323, 175/135; 403/350, 351

[56] References Cited

U.S. PATENT DOCUMENTS

| | | | |
|---|---|---|---|
| 2,297,390 | 9/1942 | Burger | 403/350 |
| 2,686,660 | 8/1954 | Storm | 175/321 |
| 2,969,250 | 1/1961 | Kull | 403/350 |
| 3,434,369 | 3/1969 | Runkle | 403/350 X |
| 3,554,306 | 1/1971 | Wilburn | 175/320 |
| 4,387,775 | 6/1983 | Adolfsson et al. | 175/320 X |

FOREIGN PATENT DOCUMENTS

| | | | |
|---|---|---|---|
| 45310 | 5/1910 | Fed. Rep. of Germany | 403/350 |
| 420787 | 12/1934 | United Kingdom | 403/351 |

*Primary Examiner*—James A. Leppink
*Assistant Examiner*—Thuy M. Bui
*Attorney, Agent, or Firm*—Ladas & Parry

[57] ABSTRACT

The invention provides an adaptor which comprises a hexagonal tail portion adapted to engage in a drilling machine, and a leading portion which is adapted to receive a circular drill rod in locking relationship. Sealing means is provided between the drilling machine and the adaptor and the latter and the drill rod.

3 Claims, 11 Drawing Figures

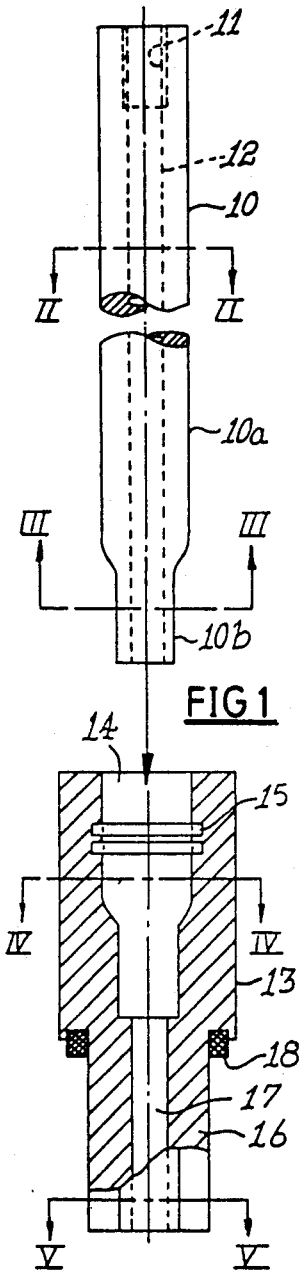
FIG 1
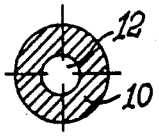
FIG 2
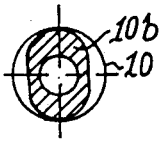
FIG 3
FIG 4
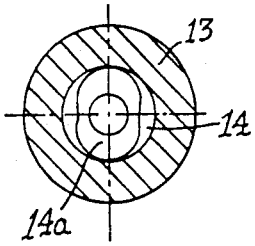
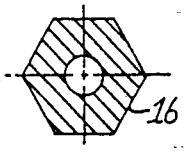
FIG 5
FIG 6
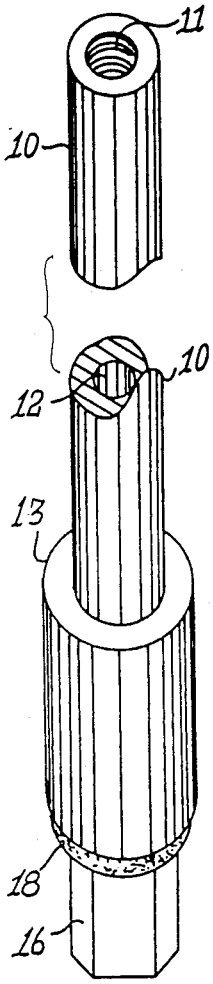

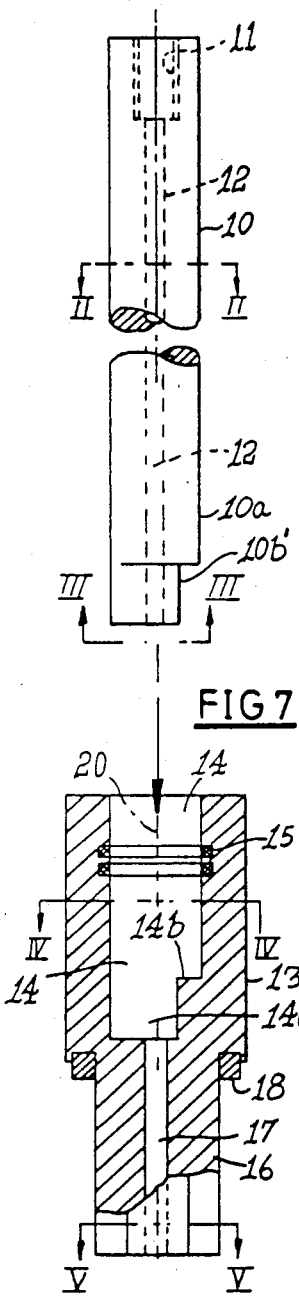
FIG 7
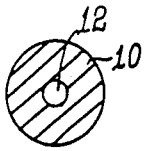
FIG 8
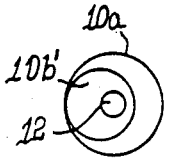
FIG 9
FIG 10
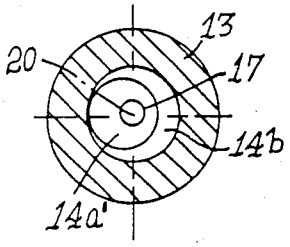
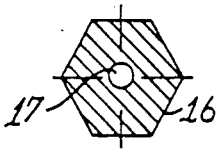
FIG 11

DRILL ADAPTOR

This invention relates to an adaptor for a drill.

In underground mining drill rods of hexagonal section are in common usage with rotary drills.

Certain advantates attach to the use of drill rods of circular cross-section in that, for example, rods of smaller diameter can be used, permitting holes of smaller diameter to be drilled, and bringing about a saving in drill rod material. However, conventional roof bolting machines and other drilling devices are adapted to receive drill rods of hexagonal section, and it is one of the objects of the present invention to provide an adaptor which will facilitate the use of drill rods which have a section other than a hexagonal one, with such machines.

According to the invention an adaptor for a drill rod comprises a body member, having a tail portion adapted to be received in a drilling machine, and a leading portion defining an axial aperture adapted snugly to receive the trailing end of the drill rod, and locking means for locking the trailing end of the drill rod relative to the body in use.

Further according to the invention the locking means is adapted to lock the drill rod and the body against relative rotation. In one arrangement the locking means could comprise complementary locking formations, such as tongue and groove formations on the drill rod and within the aperture; or cotters which are adapted to occupy part of the aperture and engage flats, grooves, or the like on the rod; or other locking formations.

Alternatively the trailing end of the drill rod may be clamped within the aperture by means of complementary tapered surfaces, wedges, wedging rollers or the like which perform a clamping operation when longitudinal force is applied to the drill rod. Clearly many other alternatives are possible in this regard.

Also according to the invention the tail portion of the body member is of hexagonal cross-section.

Still further according to the invention the body member defines a collar adjacent the tail portion, the collar being adapted to abut the drilling machine in use. Preferably a buffer ring of suitably resilient material such as rubber will be provided on the collar for sealing purposes as described more fully below.

Yet further according to the invention the body member has an axial bore therethrough adapted to convey fluid such as cooling air, cutting liquid or the like through the body. Preferably sealing means such as one or more O rings will be provided within the aperture to form a fluid tight seal between the trailing end of the drill rod and the body. Preferably also sealing means, for example in the nature of a buffer ring will be provided to form a fluid tight seal between the tail of the body member and the drilling machine. In this way fluid can be pumped from the drilling machine along the drill rod, via the adaptor of the invention without substantial leakage.

In order more clearly to illustrate the invention an embodiment thereof is described hereunder purely by way of example with reference to the accompanying drawings wherein:

FIG. 1 is an exploded elevation of an adaptor in accordance with the invention, partially sectioned and a drill rod;

FIG. 2 is a section on line II—II in FIG. 1;

FIG. 3 is a section on line III—III in FIG. 1;

FIG. 4 is a section on line IV—IV in FIG. 1;

FIG. 5 is a section on line V—V in FIG. 1;

FIG. 6 is a perspective view of the arrangement in FIG. 1;

FIG. 7 is an exploded, partially sectioned, elevation of an adaptor and a drill rod showing a different locking arrangement from that in FIG. 1;

FIG. 8 is a section on line II—II in FIG. 7;

FIG. 9 is a section on line III—III in FIG. 7;

FIG. 10 is a section on line IV—IV in FIG. 7; and

FIG. 11 is a section on line V—V in FIG. 7.

Referring to the drawings the invention provides an adaptor 13 for a drill rod 10 which is of circular configuration, FIG. 2. The drill rod 10 is provided with a threaded zone 11 at its leading end which is adapted to receive a drill bit, not shown, and defines an axial bore 12 therethrough for purposes of conveying fluid to the drill bit. The trailing end 10*a* of the drill rod 10 terminates in a tongue formation 10*b* which is formed by providing opposed flats on the end 10*a* and the purpose thereof will be described in more detail below.

The adaptor 13 includes a tail portion 16 which is of hexagonal cross section, FIG. 5 and which is adapted to be received in the chuck of a conventional drilling machine. It is envisaged that the dimensions of the tail 18 will be the same as the tail of a conventional hexagonal drill rod so that the tail 16 will be receivable in the drilling machine without any modifications to such machine being required. In this way the adaptor 13 will serve to link a drill rod of circular section to a conventional drilling machine in a simple and inexpensive manner.

The end of the adaptor 13 opposed to the tail 16 defines a circular axial aperture 14 therein which is designed to receive the trailing end 10*a* of the circular drill rod 10. The aperture 14 terminates in a slot 14*a* which is adapted to receive the tongue formation 10*b* on the trailing end 10*a* of the drill rod 10, and it will be appreciated that the inter-action between the slot 14*a* and the tongue 10*b* will prevent relative rotation between the drill rod 10 and the adaptor 13 in use. Clearly there are many other ways of preventing relative rotation between the drill rod 10 and adaptor 13 and it is not intended in any way to limit the invention to the arrangements illustrated. For example, in an alternative arrangement cotters could be used to engage flats provided on the rod 10 or the trailing end 10*a* and the aperture 14 could be tapered to provide a locking arrangement. In a further alternative rollers which are movable on wedge formations within the aperture 14 could be provided to clamp the trailing end 10*a* when axial force is applied thereto.

A yet further alternative arrangement which will be preferred in many instances is illustrated in FIGS. 7 to 11 which are numbered the same as FIGS. 1 to 5 save that alternative arrangements are indicated by an apostrophe. In the arrangement in FIGS. 7 to 11 a socket 14*a*′ is formed in the base 14*b* of the aperture 14, the socket being located eccentrically relative to the rotational axis 20 of the adaptor 13. The trailing end 10*a* of the drill rod 10 likewise defines an eccentrically disposed spigot 10*b*′ which is adapted to mate with the socket 10*a*′, and for this purpose the eccentricity and diameter of the spigot 10*d*′ and that of the socket 14*a*′ will be designed to provide a snug fit. It would be appreciated that the eccentric feature of the spigot 10*b*′ and socket 14*a*′ will prevent relative rotation between the drill rod 10 and adaptor 13 in use. Is has been found that the socket 14*a* in the base 10*b* of the aperture 14 can be formed by a drilling operation, while the spigot 10*b'* on the drill rod 10 can be formed by a turning operation, and that both these operations can be performed relatively inexpensively.

In the arrangements shown in FIG. 1 and FIG. 7 the adaptor 13 is provided with an axial bore 17 which aligns with the axial bore 12 of the drill rod 10 and permits fluid to be pumped from the drilling machine to the drill bit at the leading and of the rod 10. The adaptor 13 is formed to define a collar formation adjacent the tail portion 16, and sealing means in the form of a buffer ring 18 is provided on the collar to provide a fluid tight seal between the tail 18 and the drilling machine. Seal means in the form of a pair of O rings 15 is also provided within the aperture 14 and these serve to provide a seal between the rod 10 and the adaptor 13.

Clearly many variations of the invention exist without departing from the principle set out in the consistory clauses. For example, by varying the internal configuration of the aperture 14 a drill rod of sections other than circular could be coupled to a drilling machine by means of the adaptor 13. The adaptor described above is designed for use with a rotary type drilling machine, but clearly it can also find application with a jack hammer type drill. In such a case there will be no need to prevent relative rotation between the adaptor 13 and the rod 10, but prefereably these will be locked against longitudinal separation.

We claim:

1. An adaptor for coupling a circular drill rod to a polygonal drive socket forming part of a drilling machine, comprising a body member having a tail portion, said tail portion being receivable in the polygonal socket in spigot and socket arrangement, and being of a mating polygonal profile, the body member further having a leading portion which defines an axial recess adapted to receive a trailing end of the drill rod, the trailing end of the drill rod defining a first locking formation, and the axial recess defining a second corresponding locking formation, with inter-connection between the locking formations preventing relative rotation between the drill rod and the body, a fluid passage passing through the body member and having an inlet thereto in the zone of the polygonal tail, and an outlet therefrom in the axial recess, the body member further defining an external peripheral collar adjacent the tail, and a resilient buffer ring on the tail adjacent the collar, the collar and buffer ring forming an abutment against which the polygonal socket sealingly engages so that the fluid passage is sealed relative to the interior of the polygonal socket, and sealing means provided within the axial recess of the body to form a fluid-type seal between the tailing end of the drill rod and the outlet of the fluid passage, so that fluid can be passed from the polygonal socket along the fluid passage in the body and along an axial passage provided in the drill rod, complementary locking formations are provided on the drill rod and within the axial recess, in the form of tongue and groove formations.

2. The adaptor according to claim 1 wherein the tail portion of the body member is of hexagonal cross-section.

3. The adaptor according to claim 1 wherein the locking means comprises complementary locking formations on the drill rod and within the aperture in the form of eccentric spigot and socket formations.

* * * * *